US005590727A

United States Patent [19]

Tank et al.

[11] Patent Number: 5,590,727

[45] Date of Patent: Jan. 7, 1997

[54] TOOL COMPONENT

[76] Inventors: Klaus Tank, 9 Warbleton Avenue, Essexwold, Johannesburg; Kevin P. Ashby, No. 2 Crane Close, Dreyersdal, Western Cape, both of South Africa

[21] Appl. No.: 490,770

[22] Filed: Jun. 15, 1995

[30] Foreign Application Priority Data

Jun. 16, 1994 [ZA] South Africa ..... 94/4292

[51] Int. Cl.[6] ..... E21B 10/08; E21B 10/50

[52] U.S. Cl. ..... 175/374; 51/307; 76/108.4; 175/431; 175/432; 175/434

[58] Field of Search ..... 51/307, 309; 451/540; 407/118, 119; 175/374, 428, 434, 426, 430, 432, 420.1, 420.2, 431; 408/144, 145; 76/108.2, 108.4

[56] References Cited

U.S. PATENT DOCUMENTS

| | | | |
|---|---|---|---|
| 4,109,737 | 8/1978 | Bovenkerk | 175/430 |
| 4,861,350 | 8/1989 | Phaal et al. | 51/307 |
| 5,011,515 | 4/1991 | Frushour | 407/118 X |
| 5,119,714 | 6/1992 | Scott et al. | 76/108.2 |
| 5,472,376 | 12/1995 | Olmstead et al. | 175/428 X |
| 5,484,330 | 1/1996 | Flood et al. | 175/428 X |

FOREIGN PATENT DOCUMENTS 0476352 3/1992 European Pat. Off. .

*Primary Examiner*—Stephen J. Novosad
*Attorney, Agent, or Firm*—Scully, Scott, Murphy and Presser

[57] ABSTRACT

A tool component comprises abrasive compact, typically a diamond abrasive compact, having a flat working surface which presents a cutting edge and an opposite surface bonded to a surface of a cemented carbide substrate to define an interface having at least two steps. The steps extend from one surface of the component to another surface and the interface is spaced from the working surface at one of the component surfaces a greater distance than at the other component surface. The tool component has particular application as a cutting insert for a rotatable cutter of an earth boring bit.

12 Claims, 2 Drawing Sheets

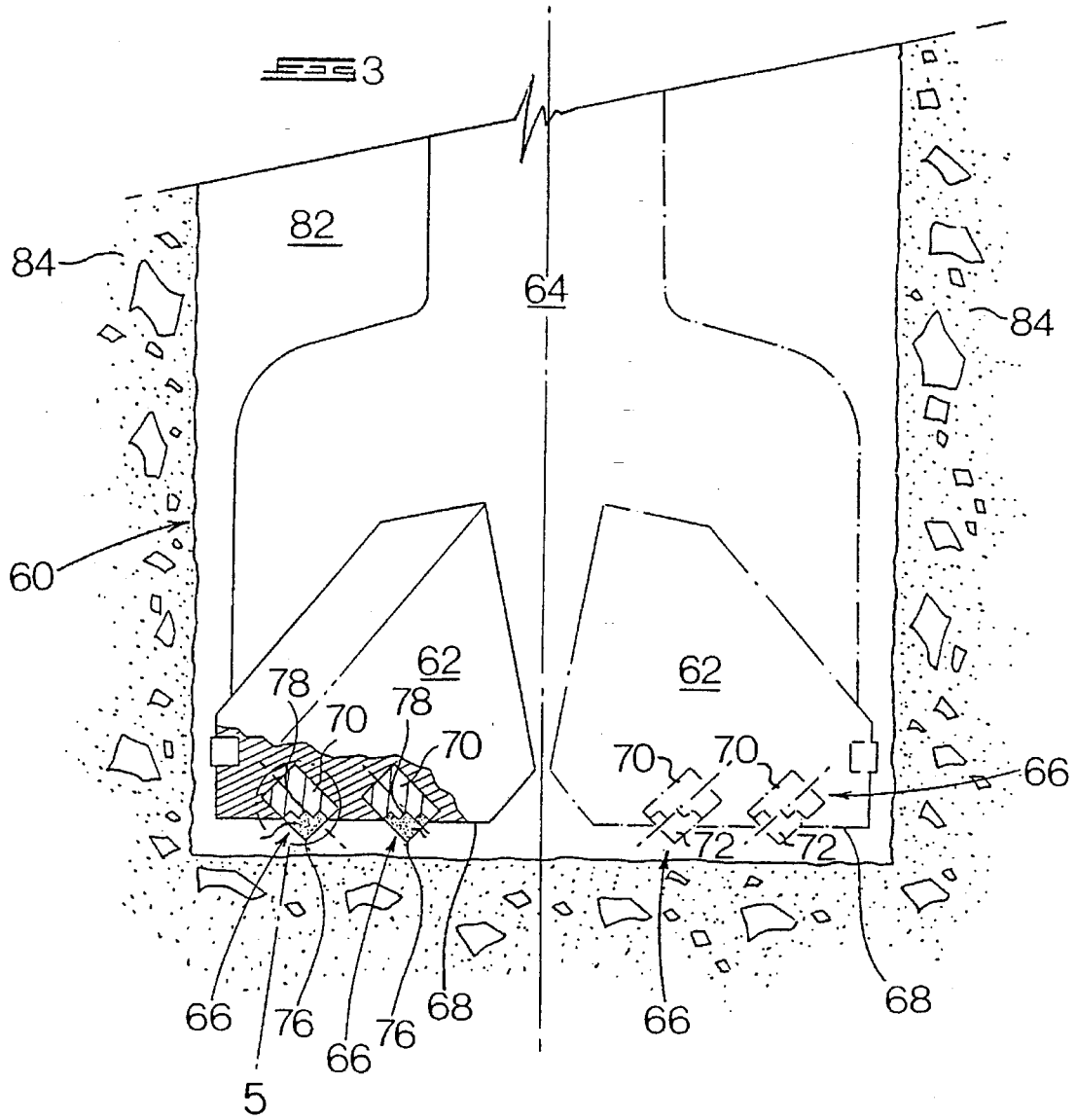
3
82
84
64
84
60
62
62
78
70
78
70
70
70
66
72
72
66
76
66
76
68
66
68
5
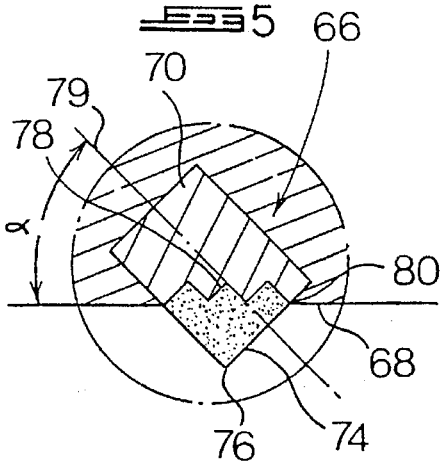
5
66
70
79
78
α
80
68
76
74
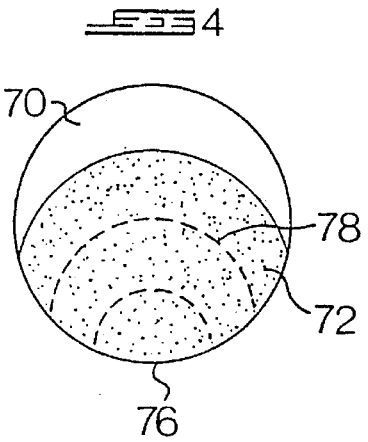
4
70
78
72
76

TOOL COMPONENT

BACKGROUND OF THE INVENTION

This invention relates to tool components.

A composite abrasive compact consists of an abrasive compact bonded to a cemented carbide substrate. The abrasive compact will generally be a diamond or cubic boron nitride compact. Such composite abrasive compacts are used extensively in industry and are described and illustrated in the patent literature..

U.S. Pat. No. 4,861,350 describes a tool component in the form of a composite abrasive compact wherein the abrasive compact has two zones which are joined by an interlocking, common boundary. The one zone provides the cutting edge or point for the tool component, while the other zone is bonded to a cemented carbide substrate. In one embodiment, the cemented carbide substrate has a central portion extending into the abrasive compact defining a peripheral abrasive compact stepped region surrounding the central portion.

Composite abrasive compacts find application in a variety of abrasive tools, including earth boring bits, also known as roller cone bits or tricone bits. Earth boring bits consist essentially of a rotatable shaft having mounted thereon a plurality of rotatable cutters. Each rotatable cutter has a plurality of spaced cutting inserts located therein. The cutting inserts may be composite abrasive compacts which are typically of a cone shape, as illustrated in U.S. Pat. No. 5,119,714.

European Patent Publication No. 0 476 352 describes an earth boring bit wherein the cutting inserts located in the rotatable cutters comprise diamond impregnated carbide containing dispersed diamond crystals.

SUMMARY OF THE INVENTION

According to the present invention, a tool component comprises an abrasive compact having a flat working surface presenting a cutting edge and an opposite surface bonded to a surface of a cemented carbide substrate to define an interface having at least two steps, the steps extending from one surface of the component to another surface and the interface being spaced from the working surface at one of the component surfaces a greater distance than at the other component surface.

The tool component of the invention finds particular application in an earth boring bit or roller cone bit. Thus, the invention provides, according to another aspect, an earth boring bit comprising at least one rotatable cutter which is rotatably mounted on a shaft and which has a plurality of cutting inserts located in a working surface thereof characterised in that at least some of the cutting inserts are tool components as described above, each of which presents a cutting edge.

DESCRIPTION OF THE DRAWINGS

FIG. 3 is a partially-sectioned diagrammatic view of another embodiment of a tool component mounted in a roller cone bit;

FIG. 4 is a plan view of the tool component illustrated in FIG. 3; and

FIG. 5 is an enlarged detail drawing of the detail circle 5 in FIG. 3.

DESCRIPTION OF EMBODIMENTS

The tool component of the invention will typically be of right circular cylindrical shape. Other shapes are possible, but for many applications, particularly as cutting inserts for earth boring bits, the right circular cylindrical shape is the preferred one.

The interface will typically extend from one side surface of the component to an opposite side surface. Thus, in the case of the tool component being a right circular cylindrical shape, the interface will typically extend from one curved side surface of the component to an opposite curved side surface. The interface may also meet or intersect the working surface of the abrasive compact.

One characterising feature of the tool component of the invention is that the interface is stepped. This stepped interface will have at least two steps, and generally at least three steps. The steps will typically comprise a first surface which is substantially parallel to the working surface and a second surface transverse thereto.

The steps will preferably define concentric arcs or parallel lines, when viewed in plan through the working surface.

The abrasive compact may be any known in the art, but will typically be a diamond compact, also known as PCD, or cubic boron nitride compact, also known as PCBN. The abrasive compact may be unimodal, i.e. the particles used in the manufacture being all of essentially the same average size, or multimodal, i.e. the particles used in the manufacture having a range of average sizes.

The cemented carbide for the substrate will be any known in the art such as cemented tungsten carbide, cemented titanium carbide, cemented tantalum carbide, cemented molybdenum carbide or mixtures thereof.

Figure 1:
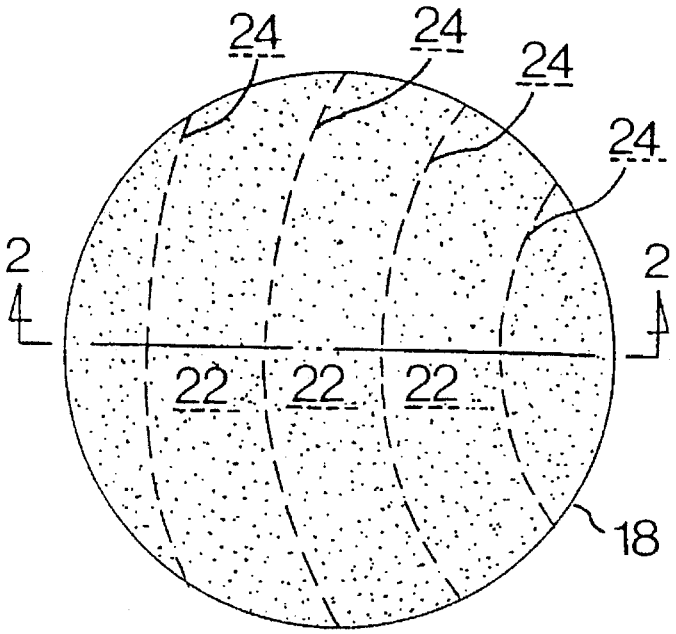
FIG. 1 is a plan view of an embodiment of a tool component of the invention.
Figure 2:
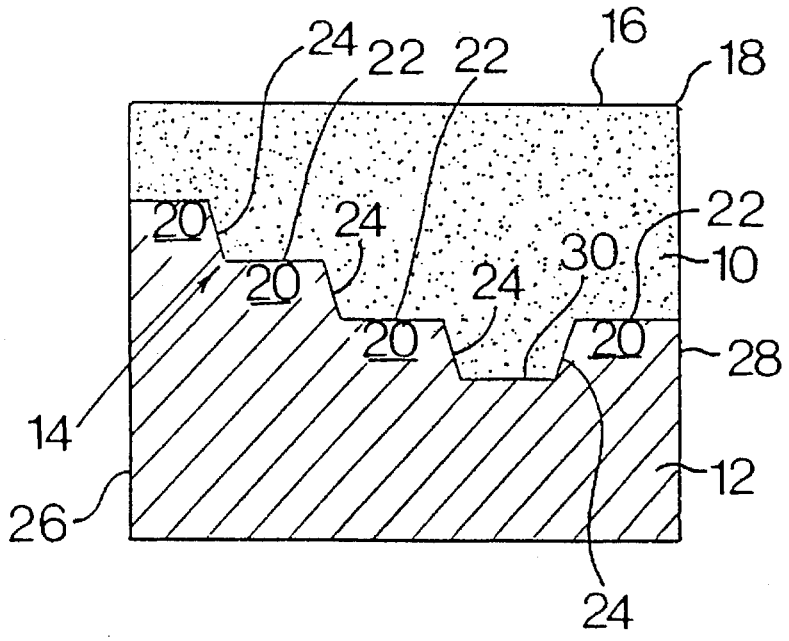
FIG. 2 is a section along the line 2—2 of FIG. 1.

Embodiments of the invention will now be described with reference to the accompanying drawings. Referring first to FIGS. 1 and 2, there is shown a tool component comprising an abrasive compact 10 bonded to a cemented carbide substrate 12 along an interface 14. The abrasive compact 10 has an upper flat working surface 16 which provides a cutting edge 18.

The interface 14 comprises a series of steps or stepped regions 20 extending in from the side surface 26. Each step has a flat surface 22 which is substantially parallel to the working surface 16 and a transverse flat surface 24. The transverse surfaces 24 are shown at an angle other than 90° to the surfaces 22. There is no significance in the angle shown. Other angles may be used. Three steps 20 are shown extending inwardly from the side 26, each step being deeper or further away from the working surface 16 as the steps progress into the compact. The lowermost step joins step 20 extending in from the side surface 28 along zone or surface 30. This completes the interface 14. The interface 14 intersects the side surface 28 a distance from the working surface 16 of the abrasive compact which is greater than that of its intersection with the surface 26.

In the embodiment of FIGS. 1 and 2, the surfaces 24 are curved, as can be seen in FIG. 1, defining a series of concentric arcs, when viewed in plan through the working surface 16. These surfaces can also be straight in which event they will define a series of parallel lines when viewed in plan through the working surface 16.

A second embodiment of the invention is illustrated by FIGS. 3, 4 and 5, wherein Fig. 5 is an enlarged detail drawing of a tool component 66 in the detail circle 5 in FIG. 3. FIG. 3 shows a roller cone bit 60 having cutters 62 rotatably mounted at the leading end of a rotatable shaft 64. The cutters 62 each have a plurality of tool components 66 of the invention mounted therein. Save for this, the roller cone bits are known in the art, as described for example in European Patent Publication No. 0 476 352 and U.S. Pat. No. 5,119,714.

The tool components 66 are mounted in the leading or working surface 68 of the cutter 62. The tool components 66 each comprise a cemented carbide substrate 70 and an abrasive compact 72. Each compact 72 has a working surface 74 providing a cutting edge 76. Further, each compact 72 is bonded to the substrate 70 along a stepped interface 78, as illustrated. The interface 78 has three steps, each step being similar to that illustrated in the FIG. 1 and 2 embodiment. The interface meets the working surface 74 along interface 80. Thus, in this embodiment, a surface of the cemented carbide substrate is coincident with the working surface 74 of the abrasive compact.

The compact 72 is, in effect, an insert in the substrate 70 which provides it with a relatively massive support.

The tool components 66 are embedded in the working surface 68 of the cutter such that the interface 78 does not extend beyond that working surface. Further, the tool components are so mounted in the working surface 68 that the longitudinal axis 79 thereof forms an angle other than 90° with the working surface. This angle is preferably in the range 30° to 60°. The components are angled into the longitudinal axis of the shaft 64, as illustrated.

The roller cone bit may be used in the usual manner to drill a hole 82 in a substrate 84 for oil or gas well applications or blind hole drilling for surface mining or in raise boring. The stepped configuration, it has been found, reduces the incidence of spalling or cracking occurring in the working surface of the abrasive compact. Further, the cutting edge 76 (and 18 in the FIGS. 1 and 2 embodiment) provide a better cutting or crushing action allowing greater loads to be applied. In the prior art, abrasive compacts presenting rounded edges in the form of buttons, for example, have been used, to reduce the incidence of spalling or cracking. The consequence of this configuration is that the penetration rates have suffered. These rates reduce further as wear flats develop on the rounded surfaces.

In the embodiments described above, the dimensions of the surfaces defining the various stepped regions can vary within wide limits. For example, in the embodiment of FIGS. 1 and 2, the flat surfaces 22 will generally be greater than the transverse surfaces 24.

The tool components of the invention may be made by methods known in the art. For example, a cemented carbide substrate having a surface profiled in the desired stepped configuration may be provided and the abrasive particles for forming the abrasive compact then placed in layer form on this stepped surface. This forms an unbonded assembly which can be subjected to conditions of elevated temperature and pressure suitable to produce the abrasive compact.

We claim:

1. An earth boring bit comprising at least one rotatable cutter which is rotatably mounted on a shaft and which has a plurality of cutting inserts located in a working surface thereof, characterized in that at least some of the cutting inserts are tool components, wherein each tool component comprises an abrasive compact having a flat working surface presenting a cutting edge and an opposite surface bonded to a surface of a cemented carbide substrate to define an interface having at least two steps, the steps extending from one surface of the component to another surface and the interface being spaced from the working surface at one of the component surfaces a greater distance than at the other component surface, and each tool component having a longitudinal axis, and the tool components are so located in the cutter that the longitudinal axis is at an angle other than 90° to the working surface of the cutter.

2. An earth boring bit according to claim 1, wherein each tool component is so embedded in the working surface that the interface lies at or below the working surface of the cutter.

3. An earth boring bit according to claim 1, wherein the angle is in the range 30 to 60°.

4. An earth boring bit according to claim 1 which is of right circular cylindrical shape.

5. An earth boring bit according to claim 1 wherein the interface extends from one side surface of the component to an opposite side surface.

6. An earth boring bit according to claim 1 wherein the interface meets the working surface of the abrasive compact.

7. An earth boring bit according to claim 1 wherein the interface has at least three steps.

8. An earth boring bit according to claim 1 wherein each step has a first surface which is substantially parallel to the working surface and a second surface transverse thereto.

9. An earth boring bit according to claim 1 wherein the steps define concentric arcs, when viewed in a plan through the working surface.

10. An earth boring bit according to claim 1 wherein the steps define parallel lines, when viewed in plan through the working surface.

11. An earth boring bit according to claim 1 wherein the abrasive compact is a diamond or cubic boron nitride compact.

12. An earth boring bit according to claim 1 wherein the cemented carbide is selected from cemented tungsten carbide, cemented tantalum carbide, cemented titanium carbide, cemented molybdenum carbide and mixtures thereof.

* * * * *